US005850581A

United States Patent [19]

Roller

[11] Patent Number: 5,850,581

[45] Date of Patent: Dec. 15, 1998

[54] PLURAL MODE MODULAR REPRODUCTION APPARATUS

[75] Inventor: George J. Roller, Penfield, N.Y.

[73] Assignee: Xerox Corporation, Stamford, Conn.

[21] Appl. No.: 777,018

[22] Filed: Jan. 21, 1997

[51] Int. Cl.[6] ..... G03G 15/00; G03G 21/16

[52] U.S. Cl. ..... 399/2; 399/107; 399/110; 399/111

[58] Field of Search ..... 399/2, 3, 107, 399/110, 111, 113, 139, 126; 347/3, 108, 49

[56] References Cited

U.S. PATENT DOCUMENTS 4,873,554 10/1989 Greco, Jr. .
5,184,178 2/1993 Takayanagi et al. ..... 399/16
5,570,159 10/1996 Hirose et al. .

*Primary Examiner*—Richard Moses
*Assistant Examiner*—Shival Virmani

[57] ABSTRACT

A dual mode modular reproduction apparatus for selective different sheet printing modes with a common shared base frame unit having integral module mounting guides providing defined simple manual module mounting into the base frame unit into the same effective location of a xerographic engine module with xerographic engine mounting elements which mate with the module mounting guides in the base frame unit for sheet printing xerographically, and an ink jet printing engine module with mounting elements which mate with the same module mounting guides in the base frame unit as the xerographic engine module to operatively mount the ink jet printing engine module in the base frame unit in place of the xerographic engine for sheet printing by the ink jet printing engine module, the xerographic engine module and the ink jet printing engine module thereby being readily manually interchangeable in the base frame unit to provide a choice between xerographic printing or ink jet printing utilizing the same base frame unit. Preferably the xerographic engine module is a monochrome printer, with a separate fuser module, and the ink jet printing engine module is a plural color ink printer, and there is also a separate document imaging station module, mounting in additional module mounting guides in the base unit, to provide an easily changeable variety of different imaging products and shared components.

2 Claims, 6 Drawing Sheets

PLURAL MODE MODULAR REPRODUCTION APPARATUS

Disclosed in the embodiment herein is a plural mode reproduction machine with readily interchangeable modular print engines and other components for easily providing a variety of very different reproduction machines with the same machine base unit, and in particular, a reproduction apparatus which is readily interchangeable between xerographic printing and ink jet printing, especially, plural color ink jet printing, for a copier, printer or multifunction reproduction apparatus.

An important advantage of the system disclosed in the embodiment herein is to provide a simple modularity interchange of entire processors to provide a completely different printing engine and printing process. One important feature and advantage thereof is to easily enable an expansion of a black only (black and white) printer product family into color printing products. Black only printing can be done xerographically at relatively low cost, and with various other advantages, even in small or low volume reproduction apparatus. However, xerographic printing rapidly becomes more expensive and requires more space as more printing colors are provided xerographically. Plural or full color printing can be provided in an ink jet printing system without a substantial space increase and at relatively lower initial apparatus cost, especially in a small low volume office reproduction apparatus where ink jet printing cost per page or speed, etc., is of lesser concern. Also, ink jet printing systems can be modified easily by changing between or adding to the number of ink jet print head cartridges, of different ink colors, etc., which are easily interchangeable, as is well known per se. Hence, it is advantageous to provide, as disclosed here, readily interchangeable black only xerographic printing modules and color ink jet printing modules which are interchangeable in the same basic space in the same reproduction apparatus and are able to use the same or similar frames, paper paths, and other components, to provide an easy upgrade from xerographic black only printing to a plural color or full color ink jet printing system, or vice versa.

A specific feature of the specific embodiment disclosed herein is to provide a dual mode modular reproduction apparatus for selective different sheet printing modes; said reproduction apparatus comprising a base frame unit, said base frame unit having integral module mounting guides, said integral module mounting guides providing defined simple manual module mounting entrances into said base frame unit, and operative module mounting in said base frame unit; a xerographic engine module with xerographic engine mounting elements which mate with said module mounting guides in said base frame unit to removably operatively mount said xerographic engine in said base frame unit for said sheet printing xerographically, and an ink jet printing engine module with mounting elements which correspond with said xerographic engine mounting elements and mate with the same said module mounting guides in said base frame unit as said xerographic engine module, to operatively mount said ink jet printing engine module in said base frame unit in place of said xerographic engine for said sheet printing by said ink jet printing engine module, said xerographic engine module and said ink jet printing engine module thereby being readily manually interchangeable in said base frame unit to provide a choice between xerographic printing or ink jet printing utilizing the same base frame unit.

Further specific features disclosed in the embodiment herein, individually or in combination, include those wherein said xerographic engine module is a monochrome printer and said ink jet printing engine module is a plural color ink printer and/or wherein said xerographic engine module and said ink jet printing engine module have copy sheet entrance positions in the same basic position as operatively mounted in said base frame unit so as to be able to receive sheets from a common sheet feeding system; and/or further including a document imaging station module, and wherein said base frame unit has additional said integral module mounting guides for said document imaging station module, for operatively connecting a said document imaging station module to said xerographic engine module or said ink jet printing engine module; and/or wherein said xerographic engine module is removable in plural submodules from said base frame unit on plural said integral module mounting guides; and/or wherein said xerographic engine plural submodules include a fuser module.

By way of background, seeking improvements in the lower cost and easier assembly of components of reproduction apparatus per se is an important technology. Cited merely as one recent patent example is U.S. Pat. No. 5,570,159 issued Oct. 29, 1996 to Shinji Hirose, et al.

There has also been, for some time, patent and product prior art on modularity of subsystem components, including modular add-on features, in copiers, printers and other reproduction apparatus. For example, xerographic print engines with interchangeable developer units having different color toners, interchangeable into the same machine locations, such as in Xerox Corp. U.S. Pat. No. 5,144,369 issued Sep. 1, 1992 to Lawrence Benedict, et al. (D/91517). Also, modular paper drawers, fusers, document handlers, etc.. For example, Xerox Corp. U.S. Pat. No. 4,873,554 issued Oct. 10, 1989 to Robert L. Greco, Jr. (R/87021) wherein the copy sheet system is a removable module.

There is also considerable prior art on the general concept of multifunction machines, in which one machine can perform several different functions, such as document scanning, local copying, remote or network printing, facsimile, etc.. That is, well known per se are multifunction machines wherein the same single integral apparatus can provide (functionally include) a copier, printer, fax direct connect printer, network capable printer, scan to file scanner, etc.. Some examples are in U.S. Pat. No. 4,947,345; 4,910,607; 4,821,107; 4,927,226; 5,396,345 and others listed, e.g., in Column 7-8 of U.S. Pat. No. 5,435,544 issued Jul. 25, 1995 to Barry Mandel and elsewhere, including various commercially available products.

There is also prior art on "Xerographic/Thermal Ink Jet Combined Printing", as exemplified by that title of Xerox Corp. U.S. Pat. No. 5,373,350 issued Dec. 13, 1994 to Thomas N. Taylor, et al. (and other art cited therein), originally filed May 1, 1992, wherein a single machine with a xerographic engine or processor produces xerographically printed copy sheets, which sheets are also printed in the same machine (serially) with an ink jet printer in that same machine (or later in another machine) which ink jet printer can provide composite images, which may be in highlight colors, printed on areas of the same sheets, for adding page annotations, letterheads, addresses, etc..

As to exemplary components and controls, since the printing and control operations of both xerographic and ink jet printing engines are well known, they need not be described herein. The disclosed systems may be operated and controlled by appropriate operation of conventional control systems. It is well known and preferable in reproduction apparatus to program and execute imaging, printing, paper handling, power switching and other control functions and logic with software instructions for conventional or general purpose microprocessors, as taught by numerous prior patents and commercial products, and commonly referred to as the reproduction machine controller. Sheet path sensors, fuser controls, image development controls, etc. are preferably provided in the machine electrically connected to the controller. The controller programming or software may of course vary depending on the particular functions, software type, and microprocessor or other computer system utilized, but will be available to, or readily programmable without undue experimentation from, prior reproduction apparatus products and literature, functional descriptions, such as those provided herein, and/or prior knowledge of functions which are conventional, together with general knowledge in the software and computer arts. Alternatively, the disclosed control system or method may be implemented partially or fully in hardware, using standard logic circuits or single chip VLSI designs. The resultant controller signals may conventionally actuate various conventional electrical components, such as well know and/or commercially available power supplies and switches, paper path drives and gates, etc., as is well known in the art. The machine control functions may all be centralized in a single motherboard area, or partially distributed in interconnecting daughterboards or chips in different modules or areas.

In the present dual mode machine system, the machine controller can be loaded with two different sets of software appropriate for the two different print processors, automatically selected by a switch associated with the insertion of the particular module, or otherwise. Alternatively, different software can be loaded into the controller when the different modules are loaded, or the software can be on a flash memory or other chip, CD ROM, or other memory device on the inserted module itself.

As to other specific components of the subject apparatus, or alternatives therefor, it will be appreciated that, as is normally the case, various such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be re-described here.

Various of the above-mentioned and further features and advantages will be apparent from the specific apparatus and its operation described in the example below, and the claims. Thus, the present invention will be better understood from this description of specific embodiments, including the drawing figures (approximately to scale) wherein:

FIG. 1 is a schematic frontal view of one embodiment of the disclosed interchangeable reproduction system, in an otherwise conventional reproduction apparatus, with the exemplary xerographic black only printing module and its fusing module fully inserted and latched in their operative positions in the common frame unit, along with a shared copy input (paper feeding) module, a scanner module, and an electronic control system (ECS) module;

Figure 1:
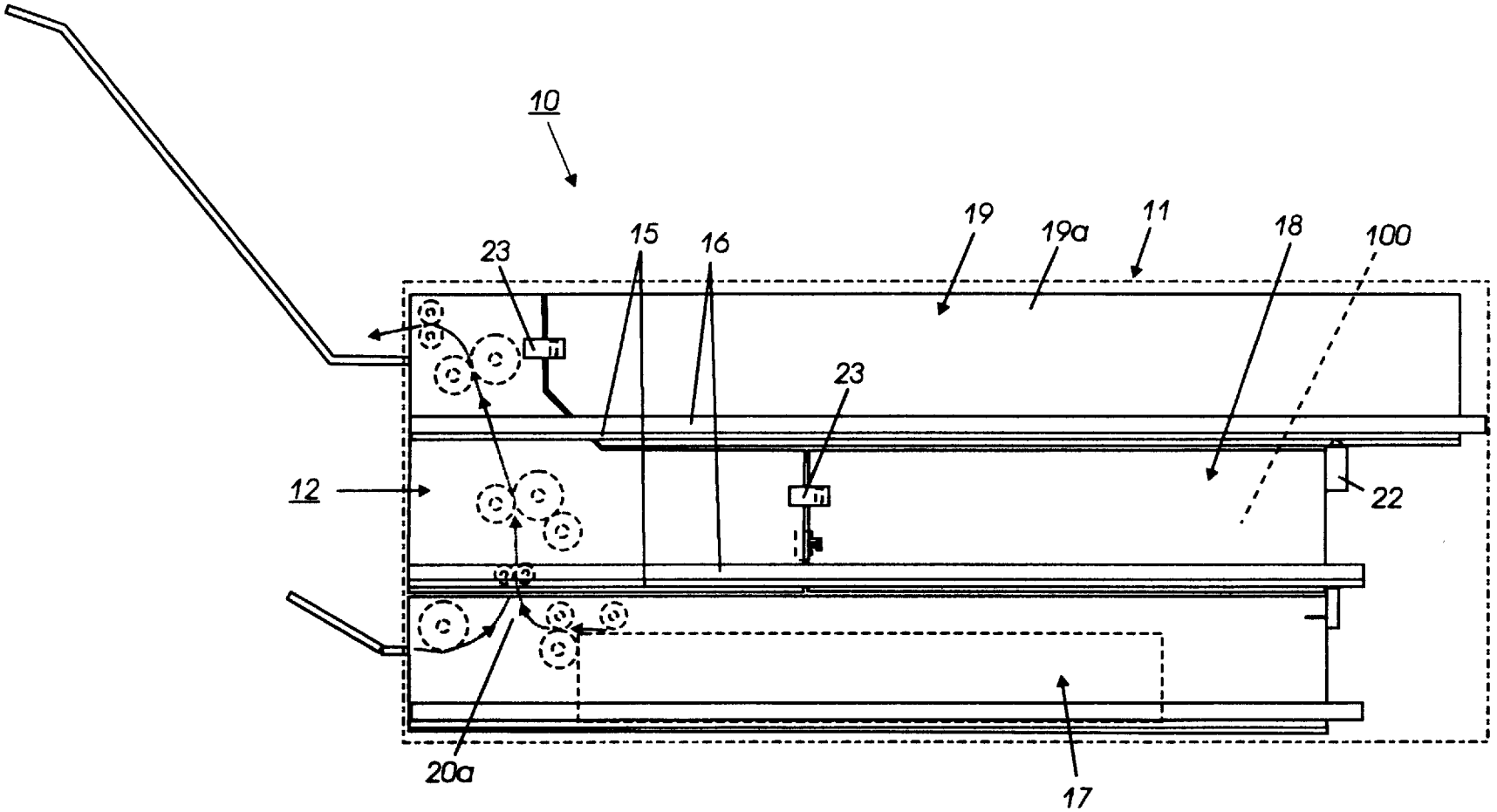
Figure 2:
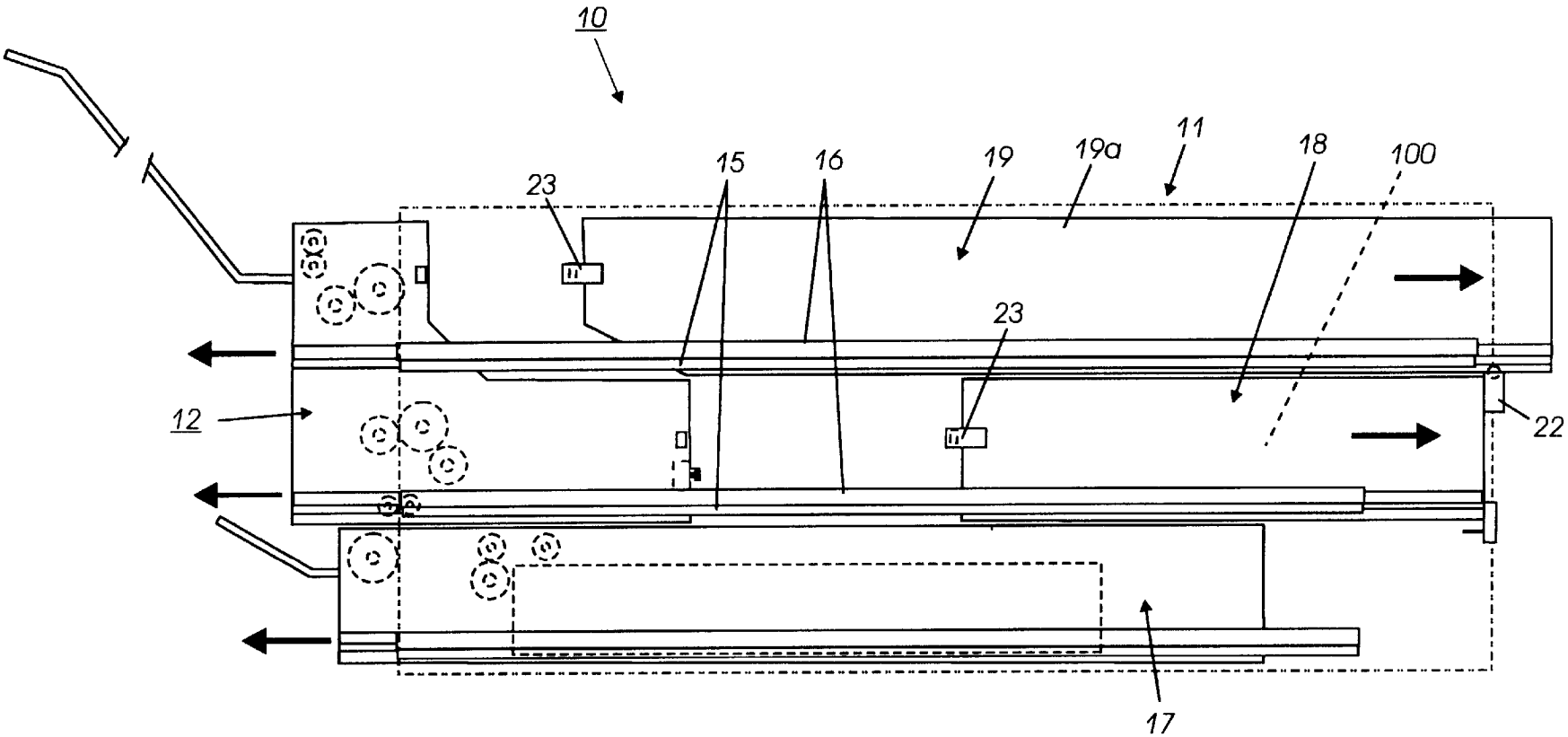
FIG. 2 is similar to FIG. 1, but showing one example of how the respective modules, especially the exemplary xerographic module and fusing module shown partially removed, can be easily removed from or inserted into the common frame unit, as illustrated by the movement arrows.
Figure 3:
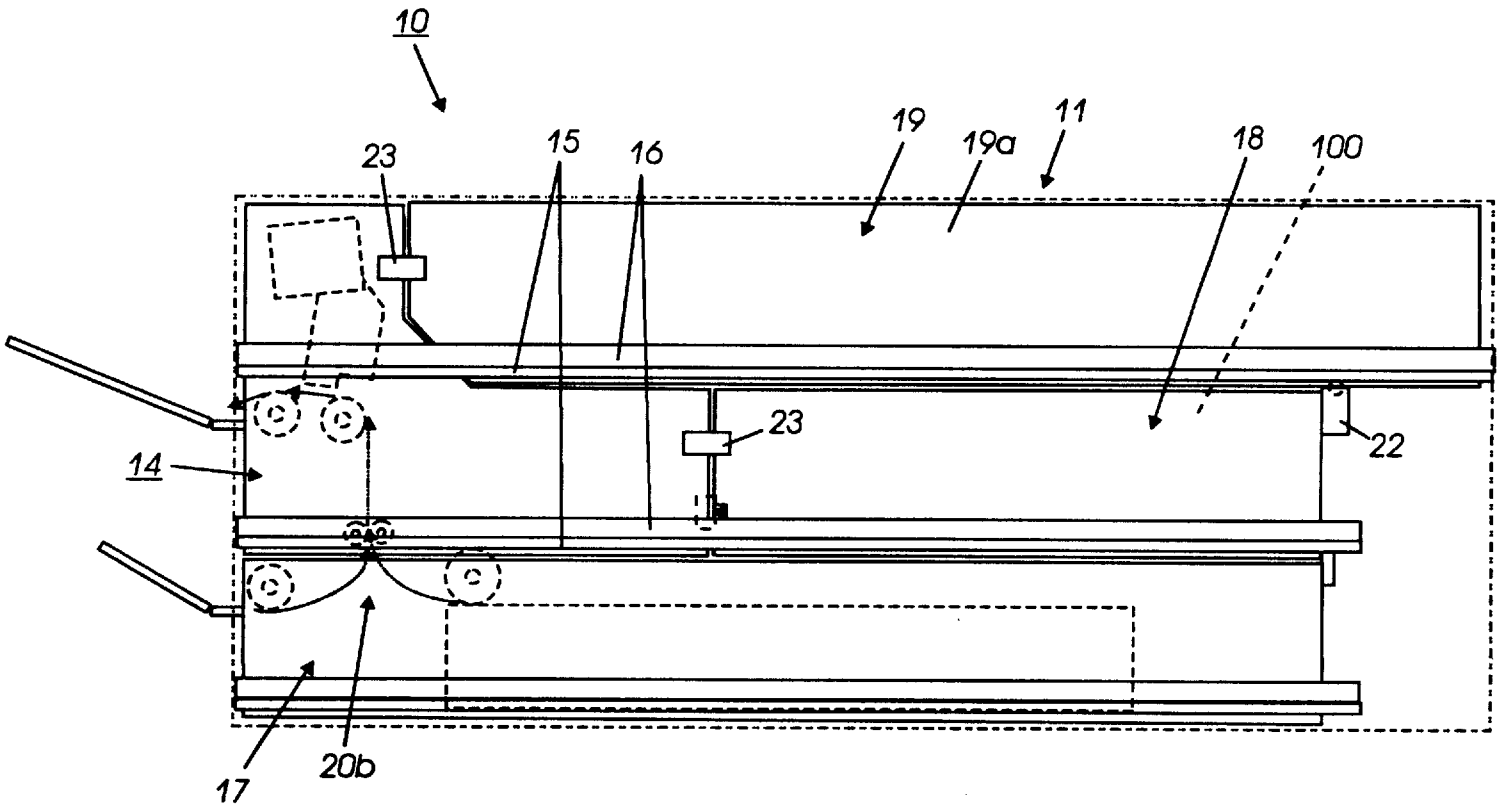
FIG. 3 shows the direct substitution of an exemplary plural color thermal ink jet printing (TIJ) module in the operative fully inserted same position previously occupied by the xerographic module and fusing module of FIGS. 1 and 2.
Figure 4:
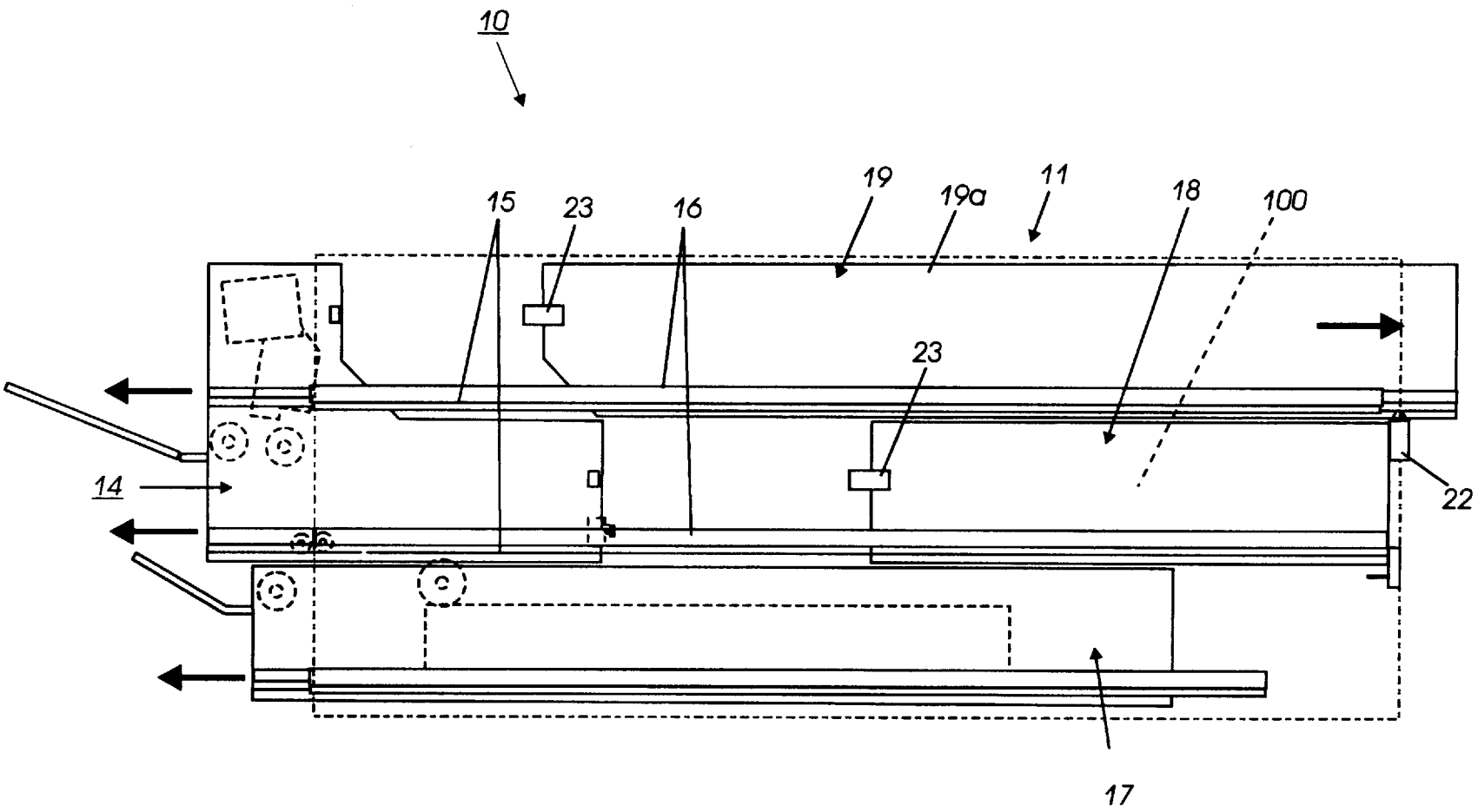
Figure 5:
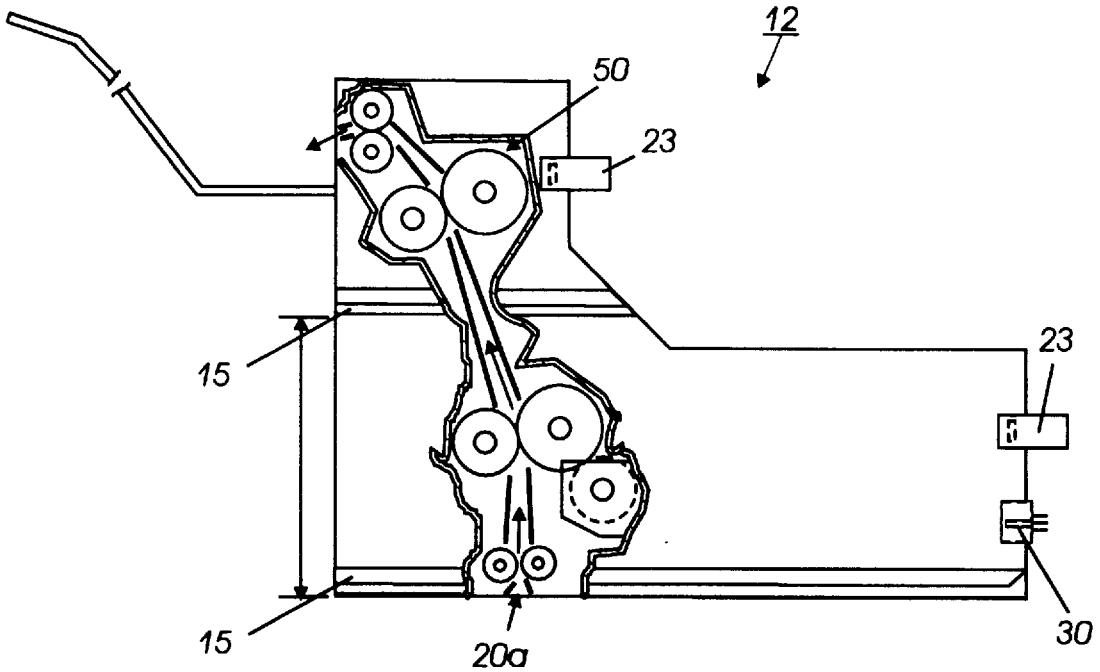
Figure 6:
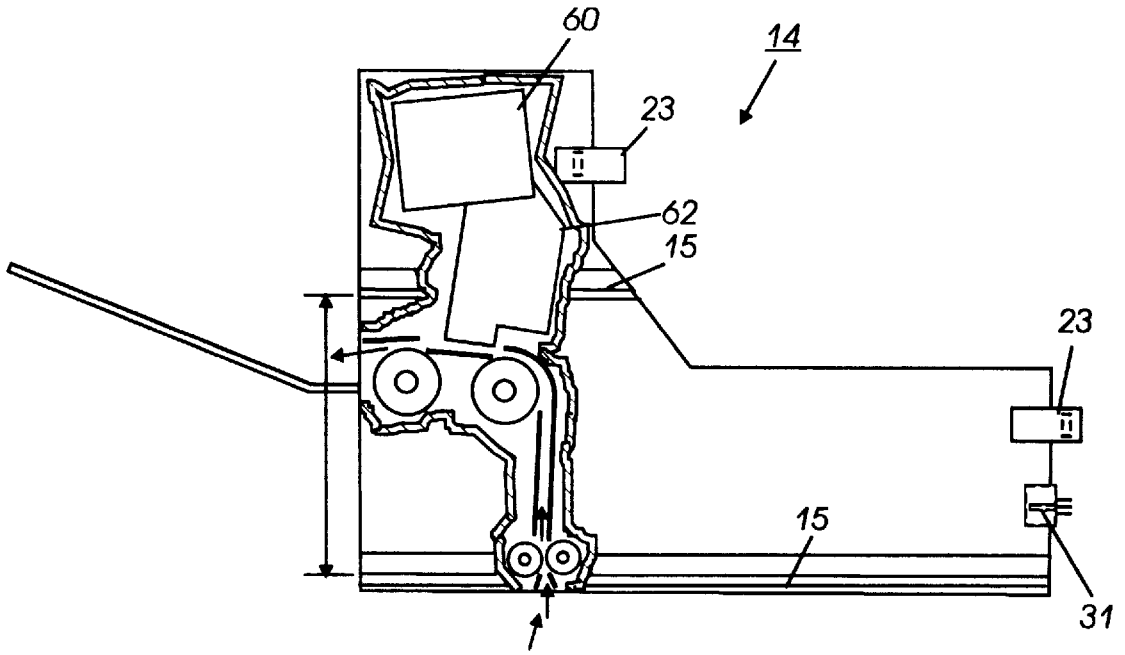
Figure 7:
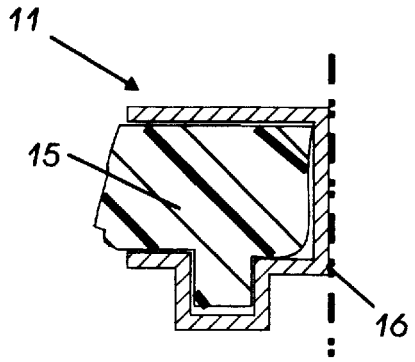
Figure 8:
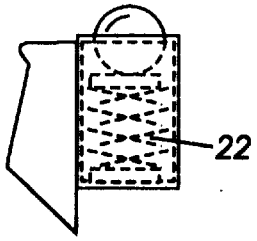
Figure 9:
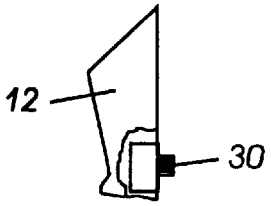
Figure 10:
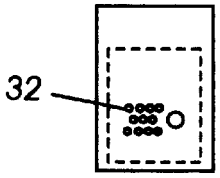
Figure 11:
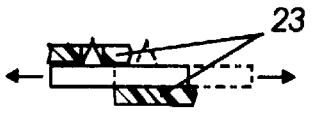

FIG. 4, like FIG. 2, shows the ease of removal and partial removal (or insertion) of the exemplary color thermal ink jet printing module of FIG. 3;

FIG. 5 shows the exemplary black only xerographic printing (TIJ) module per se (fully removed from the machine frame unit);

FIG. 6 shows the exemplary plural color ink jet printing module per se (fully removed from the machine frame unit);

FIG. 7 shows, in an enlarged transverse cross-sectional view, an exemplary slotted track or slide mounting guide portion of the machine frame unit holding and guiding an exemplary keyed module rail of one of the module embodiments of FIGS. 1–6, as one example of a guide and mounting system for the convenient horizontal inserting and removing of modules in the machine frame unit;

FIG. 8 shows one example of a simple conventional detent system for retaining a module in an operative position in the machine frame unit on said mounting guides;

FIG. 9 shows one example of a conventional multipin male electrical connector for said machine frame unit capable of electrically mating with either the inserted xerographic or TIJ module;

FIG. 10 shows an example of a conventional female multipin electrical connector for a subject module which automatically mates with the electrical connector of FIG. 9 when that module is fully inserted into its machine frame position on the correct mounting guides for that mounting position; and FIG. 11 shows one example of an module side latching system for fastening modules together in their operative positions.

Describing now in further detail this exemplary embodiment with reference to these Figures, there is shown an otherwise conventional reproduction apparatus or machine system 10, having various of the subject disclosed novel modular and other features, merely by way of one example. This disclosed system 10 differs from a conventional reproduction apparatus in that it provides a single platform for an entire family of very different products, by simple modular processor interchanges into common or shared machine elements. In particular, there is shown here a common machine frame 11 in which a xerographic monochrome marking or print engine module such as 12 (separately shown in FIG. 5) can be easily extracted and replaced by a color capable ink jet marking engine module such as 14 (separately shown in FIG. 6), or vice versa, by sliding on integral mounting rails 15 into the same basic space, on the same mounting guides or tracks 16 in the machine 10 frame 11, and therein connecting with many shared or dual mode mechanical and electrical components. As shown, preferably both modules 12 and 14 slide into the machine 10 from and into the same large opening on the same side of the machine 10. As shown in FIG. 5 and FIG. 6, the mounting rails 15 here of module 12 are the same as, and spaced the same distance apart as, the mounting rails 15 of module 14, and both are the same distance apart as the mating guides or tracks 16 so that either, but only, modules 12 or 14 can be slid into the same space in the frames 11. Other modules may have different guides and/or spacings. The illustrated module mounting guides, detents and latchs are merely exemplary, and any of various known slides, slots, hinges, pins, snap connectors or other module mounts may be used.

Furthermore, in this example, either printing engine module 12 and 14 can, when inserted, engage with and share the same entire copy paper input module 17 and its drives (or a separate drive module), the machine 10 controller 100 and its graphic user interface, if any, which may be in a separate ECS module 18 as shown, and various other components. The document imager or scanner 19 here is also in a separate removable module, and depending on the selected system 10 configuration, the scanner 19 may be not present at all, or a monochrome scanner module 19*a,* or a full color scanner 19*b.* A removable document handler module (not shown) may be conventionally provided for either scanner module 19. Various cover units may also be modularly provided, also depending on the desired module combinations and components of the selected configuration and function of the reproduction system 10 for the particular customer.

To further provide for full compatibility and interchangeability of the two print engines 12 and 14 (or CRU's, as they are called in the art), as may be particularly seen by comparing FIGS. 5 and 6, their respective sheet entrance positions 20*a* and 20*b* for receiving copy sheets therein for printing are, when inserted, in the same basic position and/or comparably engaging the same sheet output position of paper supply module 17.

As shown in this particular example, the machine frame 11 may also have known detents, such as 22 of FIG. 8, associated with the module mounting guides designed to mate with and hold corresponding mounting elements such as recesses for the detents in the same relative positions on both printing modules 12 and 14. FIG. 11 also shows, per se, one example of an module side latching system 23 for fastening modules together in their operative positions. Various suitable drawer or module mounting and detent and/or latching arrangements will be familiar to those skilled in the art which can be alternatively utilized and need not be described in detail herein.

Also preferably provided on both printing modules 12 and 14, in approximately the same relative positions thereon, is a respective electrical connector or multipin plug such as 30, 31, shown in one example in FIG. 9. Thus, when the respective module 12 or 14 is inserted into its operative position in the machine 10, either plug 30 of module 12 or plug 31 of module 14 will electrically connect with the same plug connector 32 in the machine 10, such as that shown in FIG. 10, to make power supply connections, control and paper jam detection signals, and other electrical connections with the commonly usable electrical components which remain within the machine 10, especially including the controller 100. The connector 32 could be on the machine frame 11 and/or on a mating ECS module such as 19 here.

The controller 100 can automatically tell which module was inserted from the different electrical connections provided by or through the insertion of plug 30 versus plug 31, and the respective module's connecting circuits. That information can then be used to preset or program the machine 10 appropriately for that particular print module. As noted above, with this dual mode machine system 10, the machine controller 100 can be loaded with two different sets of software, appropriate for the two different print processors 12 or 14, which appropriate software is automatically selected by the insertion of the particular module. Alternatively, as noted, different software can be loaded into the controller 100 when the different modules are loaded, or the software changes can be on a chip or other memory device on the inserted module itself.

In the case of either the xerographic module 12 or the TIJ module 14, it may also be desirable to provide a gear mesh or other mating drive connection in the same relative locations thereon, which upon insertion, mates with another in the machine 10 to provide a drive connection between the module 12 and the paper module 17 drive motor system. That allows the same drive motor system to be used for the entire paper path drive, both upstream of and internally of either module 12 or 14. As noted above, this drive motor can itself be a separately removable, e.g., rear removable, submodule.

As noted above, preferably also removably mounted to the same machine frame 11 is an imaging station or document scanning module 19. Although one modular version thereof could be an optics scanning system for optical imaging for light-lens xerography, the imager module 19 is preferably a known digital document imager so that the same module 19 can provide digital image input to a conventional laser photoreceptor scanner input of the xerographic printing module 12, when that module 12 is in use, or provide digital image input to the ink jet printing module 14 when that module 14 is in use. When the machine 10 is desired in a printer only version or configuration, that is, without scanning, copying, facsimile, or other hardcopy document input at the machine 10, then the imaging station 19 module is preferably removed, for cost savings, and a simple blank cover placed in that area. To this end, the machine 10 base frame unit 11 may have additional integral module mounting guides for the document imaging station module 19, with a separate electronics connector, for operatively connecting this document imaging station module to the respective printing engine module, directly and/or indirectly via the controller 100. As noted above, a different, monochrome, scanner 19*a* may be desired for a black only printing module 12 than for a plural color printing module 14.

It is also desirable to provide a separate removable fuser 50 in its own module, and with its own electrical connector, since it is normally not necessary to provide a fuser when the ink jet module is inserted, only for xerographic module printing, and this allows the fuser 50 module to be removed easily in that mode. Here, the xerographic engine module 12 is removable in plural submodules from the base frame unit on plural integral module mounting guides, wherein at least one of these xerographic engine plural submodules is the fuser submodule 50. As shown particularly in FIG. 6 as compared to FIG. 5, the space occupied by the fuser submodule 50 when it is inserted can be used for the ink jet ink tanks 60 and print head or heads 62.

However, another alternative is for the xerographic fuser 50, which is of course typically a heated fusing roll or belt system, to remain in the machine 10 even for the ink jet module version or configuration, but to be automatically set up to act dually as a drying element for the back-side of the liquid ink prints as they progress through the same sheet path towards the output tray outside of the reproduction apparatus. A different temperature set point may be provided automatically by an automatic software change upon the printing module interchange for effecting that dual function. This provides another optional shared functional tie-in between the two interchanged printing modules in addition to being able to share the same machine frames 11, initial paper path, etc..

Although not limited thereto, the modularity exchange of the xerographic module 12 (including the fuser) for the ink jet module 14 can most easily occur at the factory or other assembly point, to produce a variety of different products for sale which can easily be altered into different volumes of different configurations to suit customer demands, without requiring tooling or assembly line changes. However, the machine 10 reconfigurations could also by the tech rep installer, especially if different modules are manufactured in different locations or countries and drop shipped directly to customer sites. In some circumstances the desired machine configuration change could also be made or done by the end customer himself, given the simplicity provided here.

There is an aspect of electronics modularity for the product that is definitely meant to be provided and allowed by the customer after purchase. The electronics architecture of the subject machine is preferably designed such that if, for example, a customer originally bought either a xerographic or ink jet based copier per se, and at some later point in time wanted to expand its capabilities to allow it to function as a multifunction device, the customer could go to a retail outlet and buy a modular board add-on to insert to provide the desired increased function(s). Such modular upgrades can variously include fax, direct connect printing, network capable printing, scan to file in various combinations, etc.. They may be insert chips and/or circuit boards inserted in expansion slots in the existing controller 100.

While the embodiment disclosed herein is preferred, it will be appreciated from this teaching that various alternatives, modifications, variations or improvements therein may be made by those skilled in the art, which are intended to be encompassed by the following claims:

I claim:

1. A plural mode modular reproduction apparatus for selective different sheet printing modes;

said reproduction apparatus comprising a common base frame unit, said base frame unit having a sheet feeding unit, a microprocessor controller, and at least one pair of integral horizontal module mounting guide rails, said horizontal integral module mounting guide rails providing a defined dimension simple manual horizontal module mounting entrance into said base frame unit for operative module mounting within said base frame unit, a xerographic engine module with xerographic engine mounting elements which dimensionally mate with said module mounting guide rails in said base frame unit to slidably removably operatively mount said xerographic engine into said base frame unit for a xerographic said sheet printing mode, and an ink jet printing engine module with mounting elements which dimensionally correspond with said xerographic engine mounting elements and dimensionally mate with the same said module mounting guide rails in said base frame unit as said xerographic engine module, to slidably operatively mount said ink jet printing engine module into said base frame unit on said same horizontal mounting guide rails in said same base frame unit when said xerographic engine module is removed from said base frame unit, in place of said xerographic engine module, for an ink jet said sheet printing mode by said ink jet printing engine module, said xerographic engine module and said ink jet printing engine module thereby being readily manually interchangeable in said base frame unit to provide a choice between said xerographic sheet printing mode or said ink jet sheet printing utilizing the same base frame unit;

wherein a detent system holds said xerographic engine module or said ink jet printing engine module operatively within said base frame unit;

wherein said xerographic engine module and said ink jet printing engine module have electrical connectors which electrically mate with said microprocessor controller upon said respective mounting thereof into said base frame unit to differently program said microprocessor controller for the respective said module;

and wherein said xerographic engine module is removable in plural submodules from said base frame unit on plural said integral module mounting guide rails, and wherein one of said xerographic engine plural submodules is a fuser module.

2. The dual mode modular reproduction apparatus of claim 1, further including a document imaging station module, and wherein said base frame unit has additional said integral module mounting guides for said document imaging station module, for operatively connecting a said document imaging station module to said xerographic engine module or said ink jet printing engine module.

* * * * *